US010577145B2

(12) United States Patent
Bevier

(10) Patent No.: US 10,577,145 B2
(45) Date of Patent: Mar. 3, 2020

(54) LEAK RESISTANT TRAY

(71) Applicant: INTERNATIONAL PAPER COMPANY, Memphis, TN (US)

(72) Inventor: Alex Dean Bevier, Olive Branch, MS (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 95 days.

(21) Appl. No.: 15/891,833

(22) Filed: Feb. 8, 2018

(65) Prior Publication Data

US 2019/0241304 A1 Aug. 8, 2019

(51) Int. Cl.
*B65D 5/40* (2006.01)
*B65D 5/24* (2006.01)

(52) U.S. Cl.
CPC ..... *B65D 5/40* (2013.01); *B65D 5/241* (2013.01)

(58) Field of Classification Search
CPC ..... B65D 5/40; B65D 5/241; B65D 5/2033; B65D 5/002; B65D 5/0045
USPC ..... 229/186, 133, 144, 109, 187, 189, 177, 229/122.32, 918, 151, 152, 154; 206/273, 206/518
See application file for complete search history.

(56) References Cited

U.S. PATENT DOCUMENTS 978,569 A 12/1910 Elkin
2,326,926 A 8/1943 Bureau
2,366,602 A 1/1945 de Haven
2,588,455 A 3/1952 Adams
3,316,102 A 4/1967 Doll et al.
3,368,734 A 2/1968 Wainberg
3,622,064 A 11/1971 Carter et al.
4,180,200 A 12/1979 Wilkinson, Sr.
4,208,007 A 6/1980 Bamburg et al.
4,291,826 A 9/1981 Swanson
4,586,648 A 5/1986 Josefsson et al.
4,901,911 A * 2/1990 Drexhage ..... B65D 5/2047 229/114
4,919,326 A * 4/1990 Deiger ..... B65D 5/2033 229/109
5,000,374 A * 3/1991 Deiger ..... B65D 5/2033 229/103.11
5,050,766 A 9/1991 Groh
(Continued)

FOREIGN PATENT DOCUMENTS

EP 1132303 A2 9/2001

*Primary Examiner* — Christopher R Demeree
(74) *Attorney, Agent, or Firm* — Michael D. Folkerts; Thomas W. Ryan

(57) ABSTRACT

A leak resistant tray and a method of forming the tray from a blank. The blank comprises a bottom panel, first and second side panels, and first and second end portions connected to peripheral edges of the bottom panel. Each end portion includes inner end panel structure having a lower end panel and an upper end panel. Each end portion further includes first and second intermediate panels connected to the first and second side panels, first and second outer end panels connected to respective first and second intermediate panels, and first and second triangular gusset panels, each gusset panel connected between one of the intermediate panels and the lower end panel. First and second gusset trough panels are connected to a respective one of the gusset panels and to a lower edge of one of the outer end panels.

16 Claims, 4 Drawing Sheets

(56) References Cited

U.S. PATENT DOCUMENTS

| | | | | |
|---|---|---|---|---|
| 5,139,196 | A * | 8/1992 | Fry | B65D 5/10 229/109 |
| 6,102,280 | A | 8/2000 | Dowd | |
| 6,179,204 | B1 | 1/2001 | Blower et al. | |
| 7,607,567 | B2 | 10/2009 | Fry et al. | |
| 8,714,436 | B2 * | 5/2014 | Valot | B65D 5/003 229/109 |
| 8,931,686 | B2 | 1/2015 | Brundage et al. | |
| 9,457,929 | B2 | 10/2016 | Jenkins | |
| 2007/0080200 | A1 | 4/2007 | Hamblin et al. | |
| 2009/0044743 | A1 | 2/2009 | Wagenknecht et al. | |
| 2014/0084047 | A1 * | 3/2014 | McLeod | B65D 5/2033 229/109 |
| 2016/0001917 | A1 | 1/2016 | Gould et al. | |

* cited by examiner

LEAK RESISTANT TRAY

FIELD OF THE INVENTION

The present disclosure relates to containers or trays formed from a blank of material and, more particularly, to a tray that is formed with a leak resistant construction for retaining moisture or fluid within the tray.

BACKGROUND OF THE INVENTION

In some applications of containers or trays formed of folded material such as paperboard material, the container or tray may be configured to receive products having moisture or a fluid content that can leak into a base portion of the container or tray. In a known use of a tray, a package containing protein parts of poultry may be supported within the tray and the tray can provide a container that prevents leakage of fluids outside of the tray.

For example, one known type of tray can be formed from a blank of material wherein a bottom panel and a plurality of side panels may be formed of a unitary construction from a die cut and scored sheet of material. It is also known to provide such a tray construction wherein the corners adjacent to the bottom are sealed. In such a tray construction, the side panels can be integrally connected to the bottom panel along respective fold lines, and adjacent side panels can be connected by a folded gusset or web that is disposed at each corner to essentially configure the corners as leak resistant connections between panels. While such tray constructions can facilitate limiting passage of fluid from within the tray, known configurations can still permit some leakage of fluid from the tray, such as may result from passage of fluid through the gusset area. In an alternative tray configuration formed of corrugated material, such as to optimize vertical stacking strength of the tray, the tray may not obtain the full benefit of the material strength due to fluid entering the corrugated material from within the tray through openings in the material, such as via slots or slits formed in the material.

SUMMARY OF THE INVENTION

In accordance with an aspect of the invention, a blank for making a leak resistant tray is provided. The blank comprises a bottom panel having a plurality of peripheral edges, first and second side panels connected to the bottom panel at opposing lateral peripheral edges and defining lower edges of the tray, and first and second end portions located at opposing longitudinal ends of the blank. Each end portion includes inner end panel structure connected to a longitudinal peripheral edge of the bottom panel, and the inner end panel structure includes a lower end panel and an upper end panel. Each end portion further includes: first and second intermediate panels, each intermediate panel connected to a respective one of the first and second side panels and having an edge defining a lower edge of the tray; first and second outer end panels, each outer end panel connected to a respective one of the first and second intermediate panels and having an edge defining a lower edge of the tray; first and second triangular gusset panels, each gusset panel connected between one of the intermediate panels and the lower end panel; and first and second gusset trough panels, each gusset trough panel connected to one of the gusset panels and to the lower edge of one of the outer end panels.

The lower end panel may comprise a trapezoidal shape.

A longitudinal dimension of the lower end panel, extending in a direction from the bottom panel to the upper end panel, may be generally equal to a longitudinal dimension of the intermediate panels.

An edge of each intermediate panel and an edge of a respective adjacent outer end panel may be collinear with a lateral peripheral edge of the bottom panel.

The first and second gusset trough panels may each include an edge adjacent to a lateral edge the upper end panel and separated from the lateral edge of the upper end panel by a slit. The slit may extend from a connection between the lower end panel and the upper end panel.

The blank may be formed of a corrugated cardboard material including an interior defined by elongated flutes, and a direction of elongation of the flutes may extend in a lateral direction parallel to the longitudinal peripheral edges of the bottom panel.

The lower end panel may connect to a longitudinal peripheral edge of the bottom panel at a location defining a lower edge of the tray.

In accordance with another aspect of the invention, a tray formed from a blank is provided and includes a bottom panel having a plurality of peripheral edges, first and second side panels connected to the bottom panel at opposing lateral peripheral edges and folded upward relative to the bottom panel, and first and second end portions located at opposing longitudinal ends of the blank. Each end portion includes inner end panel structure connected to a longitudinal peripheral edge of the bottom panel, and the inner end panel structure includes a lower end panel. Each end portion further includes: first and second intermediate panels, each intermediate panel connected to a respective one of the first and second side panels and extending upward from the bottom panel; first and second outer end panels, each outer end panel connected to a respective one of the first and second intermediate panels and extending generally perpendicular to the side panels; first and second triangular gusset panels, each gusset panel connected between one of the intermediate panels and the lower end panel and extending downward from the lower end panel; and first and second gusset trough panels, each gusset trough panel connected to one of the gusset panels and to the lower edge of one of the outer end panels and folded upward to overlapping relationship with a respective outer end panel.

Each of the gusset panels may be located in overlapping relationship with a respective intermediate panel.

An edge of the first and second outer end panels connected to respective ones of the gusset trough panels may define a lower edge of the tray.

An edge of the intermediate panels connected to the gusset panels may define a lower edge of the tray.

The first outer end panel may be located in overlapping relationship with the second outer end panel.

The inner end panel structure may further include an upper end panel connected to the lower end panel, and the first and second outer end panels may be located in overlapping relationship with the upper end panel to define a tray end wall generally perpendicular to the bottom panel.

The lower end panel may extend upward and outward from the bottom panel to the tray end wall.

The side panels, intermediate panels, and tray end walls may define an octagonal wall structure for the tray.

The blank may be formed of a corrugated cardboard material including an interior defined by elongated flutes, and a direction of elongation of the flutes in the side panels, the intermediate panels and the outer end panels may extend in a vertical direction generally perpendicular to the bottom panel.

In accordance with a further aspect of the invention, a method of forming a tray from a blank is provided. The blank comprises a bottom panel having a plurality of peripheral edges, first and second side panels connected to the bottom panel at opposing lateral peripheral edges, and first and second end portions located at opposing longitudinal ends of the blank. Each end portion includes inner end panel structure connected to a longitudinal peripheral edge of the bottom panel, and the inner end panel structure includes a lower end panel. Each end portion further includes first and second intermediate panels connected to respective ones of the first and second side panels, first and second outer end panels connected to respective ones of the first and second intermediate panels, first and second triangular gusset panels between respective ones of the intermediate panels and the lower end panel, and first and second gusset trough panels, each gusset trough panel connected to one of the gusset panels and to the lower edge of one of the outer end panels. The method includes forming an end portion of the tray comprising: folding the first gusset panel downward from the lower end panel while folding the first side panel upward relative to the bottom panel; folding the first intermediate panel upward at a connection with the first gusset panel while folding the first outer end panel upward at a connection with the first gusset trough panel; and folding the first outer end panel and the first gusset trough panel relative to the first intermediate panel about a generally vertical axis to position the first outer end panel and the first gusset trough panel generally perpendicular to the first side panel.

Forming an end portion of the tray may further comprise: folding the second gusset panel downward from the lower end panel while folding the second side panel upward relative to the bottom panel; folding the second intermediate panel upward at a connection with the second gusset panel while folding the second outer end panel upward at a connection with the second gusset trough panel; and folding the second outer end panel and the second gusset trough panel relative to the second intermediate panel about a generally vertical axis to position the second outer end panel and the second gusset trough panel generally perpendicular to the second side panel and in overlapping relationship with the first outer end panel.

Forming an end portion of the tray may further comprise positioning an upper end panel of the inner end panel structure in overlapping relationship with the first and second outer end panels to define an inner surface of the tray.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
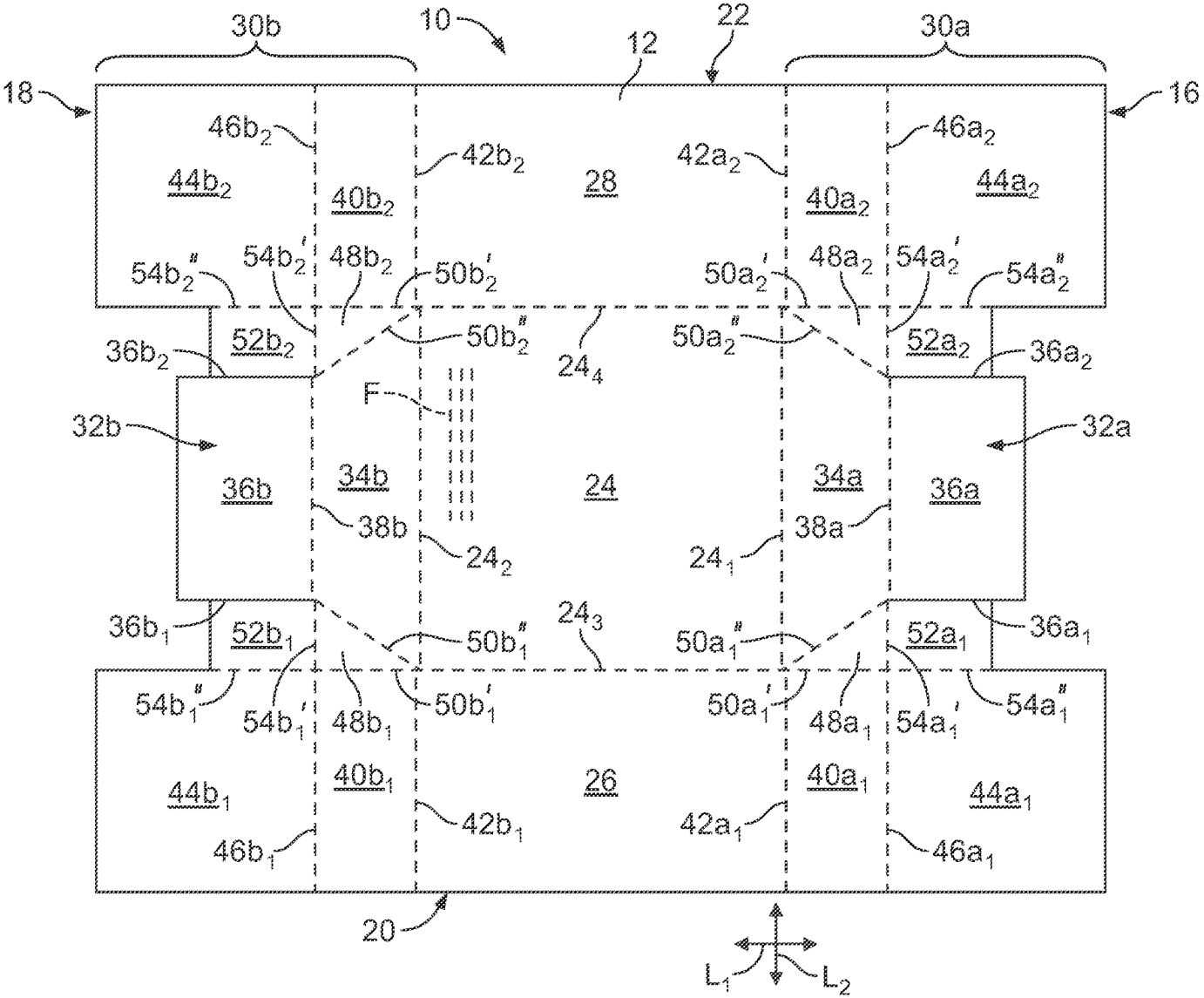
FIG. 1 is a plan view of a blank for forming a leak resistant tray.

Referring to FIG. 1, a die cut blank 10 is shown for illustrating one or more aspects of a container or tray comprising a leak resistant tray, as described herein. In a use of the blank 10 to form a one-piece leak resistant tray 8, see FIG. 6, the blank 10 may be formed of a corrugated cardboard material having an interior portion defined by elongated flutes, generally designated F in FIG. 1, as is generally known in the art, and may be die cut to the shape shown herein, although other materials and variations of the illustrated shape may be provided within the scope of the tray described herein. The blank 10 illustrated in FIG. 1 is a planar piece of material in which an inner side 12 is shown facing out of the page and an outer side 14, see FIG. 7, faces in an opposite direction from the inner side 12.

As seen in FIG. 1, the blank 10 extends in a longitudinal direction $L_1$ between first and second longitudinal ends, generally designated 16 and 18, respectively, and further extends in a lateral direction $L_2$, perpendicular to the longitudinal direction $L_1$, between first and second lateral edges, generally designated 20 and 22, respectively. The blank comprises a bottom panel 24 having a plurality of peripheral edges $\mathbf{24}_1$, $\mathbf{24}_2$, $\mathbf{24}_3$, $\mathbf{24}_4$. A first side panel 26 is connected to the bottom panel 24 along a score line at the lateral peripheral edge $\mathbf{24}_3$, and a second side panel 28 is connect the bottom panel 24 along a score line at the opposing lateral peripheral edge $\mathbf{24}_4$. The lateral peripheral edges $\mathbf{24}_3$, $\mathbf{24}_4$ define lower edges of the erected tray, as will be described further below.

First and second end portions 30*a*, 30*b* are located at the opposing longitudinal ends 16, 18 of the blank 10. Each end portion 30*a*, 30*b* includes a respective first and second inner end panel structure 32*a*, 32*b* connected to the longitudinal peripheral edges $\mathbf{24}_1$, $\mathbf{24}_2$ of the bottom panel 24 and extending between the lateral peripheral edges $\mathbf{24}_3$, $\mathbf{24}_4$. The first inner end panel structure 32*a* includes a lower end panel 34*a* and an upper end panel 36*a*. The lower end panel 34*a* defines a trapezoidal shape and is connected to the bottom panel 24 along a score line at the longitudinal peripheral edge $\mathbf{24}_1$ for defining a lower edge of the erected tray, and the upper end panel 36*a* is joined to the lower end panel 34*a* along a score line 38*a* extending in the lateral direction $L_2$. Similarly, the second inner end panel structure 32*b* includes a lower end panel 34*b* and an upper end panel 36*b*. The lower end panel 34*b* is connected to the bottom panel 24 along a score line at the longitudinal peripheral edge $\mathbf{24}_2$ for defining a lower edge of the erected tray, and the upper end panel 36*b* is joined to the lower end panel 34*b* along a score line 38*b* extending in the lateral direction $L_2$.

The end portion 30*a* further includes first intermediate panels 40$a_1$, 40$a_2$ wherein a longitudinal dimension of the lower end panel 34*a*, extending in the longitudinal direction $L_1$ from the bottom panel 24 to the upper end panel 36*a*, is generally equal to a longitudinal dimension of the intermediate panels 40$a_1$, 40$a_2$. The end portion 30*b* further includes second intermediate panels 40$b_1$, 40$b_2$ wherein a longitudinal dimension of the lower end panel 34*b*, extending in the longitudinal direction $L_1$ from the bottom panel 24 to the upper end panel 36*b*, can be generally equal to a longitudinal dimension of the intermediate panels 40$b_1$, 40$b_2$. The first and second intermediate panels 40$a_1$, 40$a_2$ are connected to the respective side panels 26, 28 along score lines 42$a_1$, 42$a_2$ that are collinear with the longitudinal peripheral edge 24$_1$. The first and second intermediate panels 40$b_1$, 40$b_2$ are connected to the respective side panels 26, 28 along score lines 42$b_1$, 42$b_2$ that are collinear with the longitudinal peripheral edge 24$_2$. It may be noted that although the longitudinal dimension of the lower end panel 34*b* and the intermediate panels 40$b_1$, 40$b_2$ is described as being generally equal, other embodiments of the tray 8 can be constructed in which the lower end panel 34*b* has a longitudinal dimension that is different from the longitudinal dimension of the intermediate panels 40$b_1$, 40$b_2$.

The first end portion 30*a* includes first and second outer end panels 44$a_1$, 44$a_2$, connected to the first and second intermediate panels 40$a_1$, 40$a_2$ along score lines 46$a_1$, 46$a_2$ that are collinear with the score line 38*a*. Similarly, the second end portion 30*b* includes first and second outer end panels 44$b_1$, 44$b_2$, connected to the first and second intermediate panels 40$b_1$, 40$b_2$ along score lines 46$b_1$, 46$b_2$ that are collinear with the score line 38*b*.

The first end portion 30*a* includes a first triangular gusset panel 48$a_1$ connected between the first intermediate panel 40$a_1$ and the lower end panel 34*a*, and a second triangular gusset panel 48$a_2$ is connected between the second intermediate panel 40$a_2$ and the lower end panel 34*a*. The first gusset panel 48$a_1$ includes a first edge connected to the first intermediate panel 40$a_1$ along a score line 50$a_{1'}$ collinear with the lateral peripheral edge 24$_3$, and includes a second edge connected to an angled edge of the lower end panel 34*a* along a score line 50$a_{1''}$. Similarly, the second gusset panel 48$a_2$ includes a first edge connected to the second intermediate panel 40$a_2$ along a score line 50$a_{2'}$ collinear with the lateral peripheral edge 24$_4$, and includes a second edge connected to an angled edge of the lower end panel 34*a* along a score line 50$a_{2''}$.

The second end portion 30*b* includes a gusset structure similar to that described for the first end portion 30*a*. In particular, the second end portion 30*b* includes a first triangular gusset panel 48$b_1$ connected between the first intermediate panel 40$b_1$ and the lower end panel 34*b*, and a second triangular gusset panel 48$b_2$ is connected between the second intermediate panel 40$b_2$ and the lower end panel 34*b*. The first gusset panel 48$b_1$ includes a first edge connected to the first intermediate panel 40$b_1$ along a score line 50$b_{1'}$ collinear with the lateral peripheral edge 24$_3$, and includes a second edge connected to an angled edge of the lower end panel 34*b* along a score line 50$b_{1''}$. Similarly, the second gusset panel 48$b_2$ includes a first edge connected to the second intermediate panel 40$b_2$ along a score line 50$b_{2'}$ collinear with the lateral peripheral edge 24$_4$, and includes a second edge connected to an angled edge of the lower end panel 34*b* along a score line 50$b_{2''}$.

The first end portion 30*a* includes first and second rectangular gusset trough panels 52$a_1$, 52$a_2$ connected to respective gusset panels 48$a_1$, 48$a_2$ and connected to respective outer end panels 44$a_1$, 44$a_2$. In particular, the first gusset trough panel 52$a_1$ includes a first edge connected to a third edge of the gusset panel 48$a_1$ at a score line 54$a_{1'}$ collinear with the score line 46$a_1$, and the first gusset trough panel 52$a_1$ includes a lateral second edge connected to the outer end panel 44$a_1$ at a score line 54$a_{1''}$ collinear with the score line 50$a_{1'}$. The second gusset trough panel 52$a_2$ includes a first edge connected to a third edge of the gusset panel 48$a_2$ at a score line 54$a_{2'}$ collinear with the score line 46$a_2$, and the second gusset trough panel 52$a_2$ includes a lateral second edge connected to the outer end panel 44$a_2$ at a score line 54$a_{2''}$ collinear with the score line 50$a_{2'}$. Further, the first and second gusset trough panels 52$a_1$, 52$a_2$ each include an edge adjacent to a respective lateral edge 36$a_1$, 36$a_2$ of the upper end panel 36*a* and separated from the respective lateral edge 36$a_1$, 36$a_2$ of the upper end panel 36*a* by a slit that extends from a connection between the lower end panel 34*a* and the upper end panel 36*a*, i.e., at the score line 38*a*.

Similarly, the second end portion 30*b* includes first and second rectangular gusset trough panels 52$b_1$, 52$b_2$ connected to respective gusset panels 48$b_1$, 48$b_2$ and connected to respective outer end panels 44$b_1$, 44$b_2$. In particular, the first gusset trough panel 52$b_1$ includes a first edge connected to a third edge of the gusset panel 48$b_1$ at a score line 54$b_{1'}$ collinear with the score line 46$b_1$, and the first gusset trough panel 52$b_1$ includes a lateral second edge connected to the outer end panel 44$b_1$ at a score line 54$b_{1''}$ collinear with the score line 50$b_{1'}$. The second gusset trough panel 52$b_2$ includes a first edge connected to a third edge of the gusset panel 48$b_2$ at a score line 54$b_{2'}$ collinear with the score line 46$b_2$, and the second gusset trough panel 52$b_2$ includes a lateral second edge connected to the outer end panel 44$b_2$ at a score line 54$b_{2''}$ collinear with the score line 50$b_{2'}$. Further, the first and second gusset trough panels 52$b_1$, 52$b_2$ each include an edge adjacent to a respective lateral edge 36$b_1$, 36$b_2$ of the upper end panel 36*b* and separated from the respective lateral edge 36$b_1$, 36$b_2$ of the upper end panel 36*b* by a slit that extends from a connection between the lower end panel 34*b* and the upper end panel 36*b*, i.e., at the score line 38*b*. The gusset panels 48$a_1$, 48$a_2$, 48$b_1$, 48$b_2$ and respective gusset trough panels 52$a_1$, 52$a_2$, 52$b_1$, 52$b_2$ form gusset structures configured to prevent passage of fluids contained within the tray 8 formed by the blank 10, as will be described further below.

From the above description it may be understood that the second end portion 30*b* is a mirror image of the first end portion 30*a*, such that a folding operation performed on the first end portion 30*a*, as described below with reference to FIGS. 2-7, is substantially similar to a folding operation that can be performed on the second end portion 30*b*. It may be understood that a folding operation for erecting the blank 10 into a tray may be performed manually or by a machine, or by a combination of manual and machine steps. Further, it may be understood that, although the steps described for folding the blank may refer to folding one end of the blank 10, e.g., end portion 30*a*, or folding one side of the blank 10, e.g., the blank panels labeled with a subscript "1", this form of description is provided for understanding of the folding steps and a relative positioning of panels, and similar steps may be provided simultaneously at both ends and/or on both sides of the blank 10.

Figure 2:
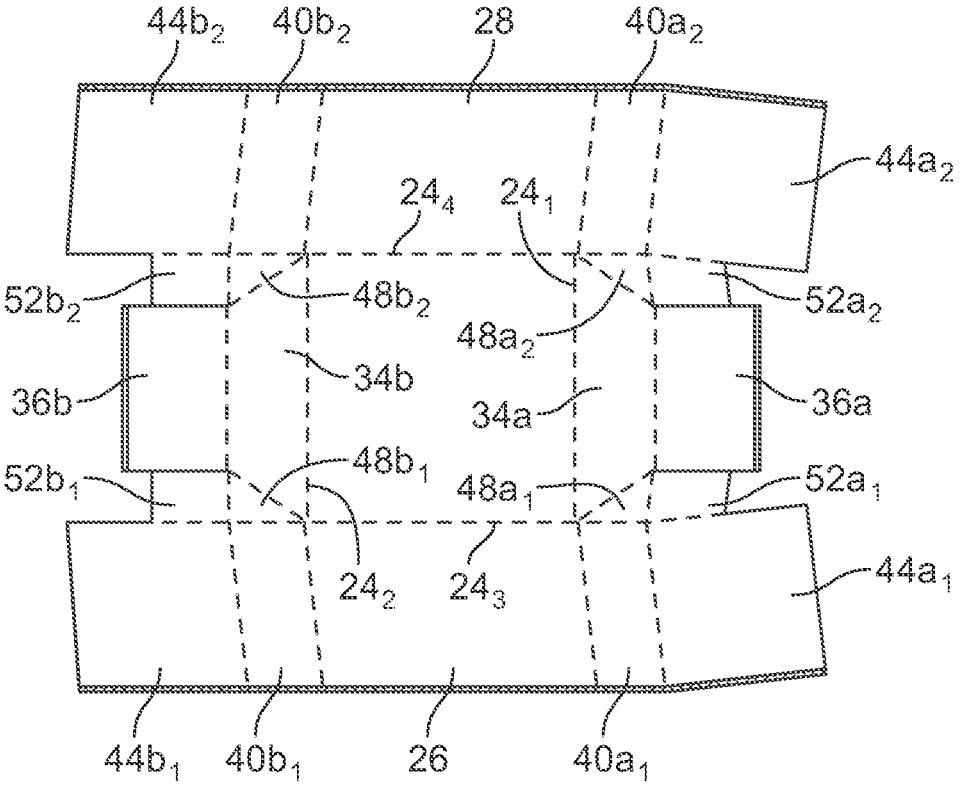
FIG. 2 is a perspective view of an initial step in folding the blank to erect the leak resistant tray.
Figure 3:
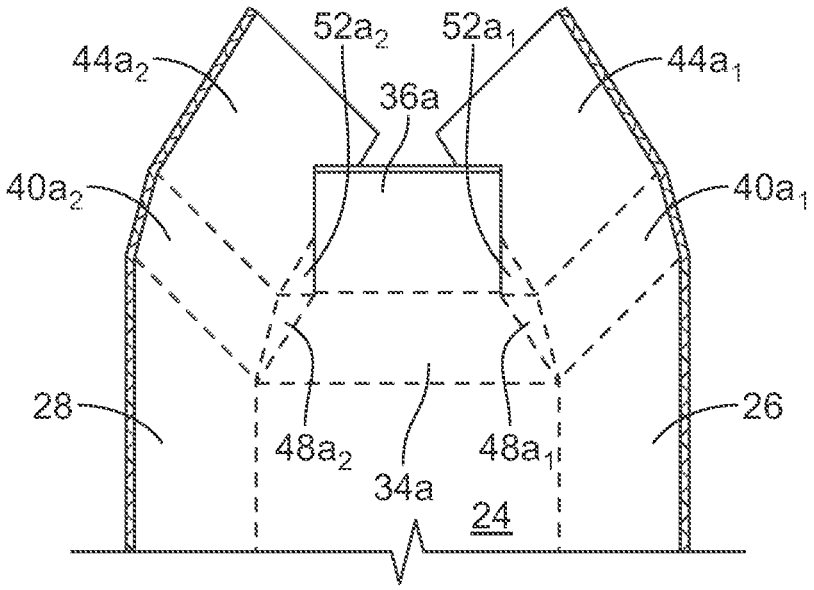
FIG. 3 is a perspective view of a first end of the blank illustrating a step of folding side panels upward and initial folding of a first end portion.
Figure 4:
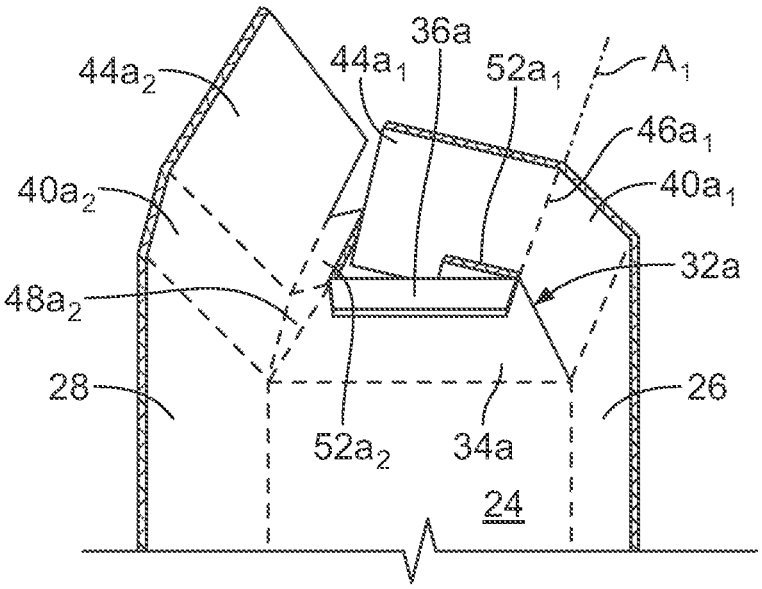
FIG. 4 is a perspective view illustrating folding a first outer end panel and gusset trough panel behind an inner end panel structure of the first end portion.

Referring initially to FIG. 2, as an initial step in folding the blank 10, the gusset panels 48$a_1$, 48$a_2$ and gusset trough panels 52$a_1$, 52$a_2$ can be folded back or downward relative to the lower end panel 34*a*, and the side panels 26, 28 can be partially folded upward relative to the bottom panel 24. During this folding operation, the inner end panel structure 32*a* can be folded upward relative the bottom panel 24, i.e., the lower end panel 34*a* can be folded upward about the score line $\mathbf{24}_1$. Referring to FIGS. 3 and 4, the first and second gusset panels $\mathbf{48}a_1$, $\mathbf{48}a_2$ and the first and second gusset trough panels $\mathbf{52}a_1$, $\mathbf{52}a_2$ are shown folded behind the lower end panel 34*a*, and the first and second intermediate panels $\mathbf{40}a_1$, $\mathbf{40}a_2$ are folded upward relative to the respective first and second gusset panels $\mathbf{48}a_1$, $\mathbf{48}a_2$. Further, the first and second end panels $\mathbf{44}a_1$, $\mathbf{44}a_2$ are folded upward relative to the first and second gusset trough panels $\mathbf{52}a_1$, $\mathbf{52}a_1$ wherein the first end panel $\mathbf{44}a_1$ is shown in FIG. 4 positioned behind the inner end panel structure 32*a*.

As seen in FIGS. 3 and 4, the first gusset panel $\mathbf{48}a_1$ is further folded into overlapping relationship positioned against the first intermediate panel $\mathbf{40}a_1$, and the first gusset trough panel $\mathbf{52}a_1$ is folded into overlapping relationship positioned against the first outer end panel $\mathbf{44}a_1$. The first outer end panel $\mathbf{44}a_1$ and the first gusset trough panel $\mathbf{52}a_1$ are folded relative to the first intermediate panel $\mathbf{40}a_1$ about a generally vertical fold axis $A_1$, generally collinear with the score line $\mathbf{46}a_1$, to position the first outer end panel $\mathbf{44}a_1$ and the overlapping first gusset trough panel $\mathbf{52}a_1$ generally perpendicular to the first side panel 26, see FIGS. 4 and 5. The upper end panel 36*a* is positioned in overlapping relationship against the first outer end panel $\mathbf{44}a_1$ and can be adhesively attached together with their upper edges aligned at an upper edge of the tray.

Figure 5:
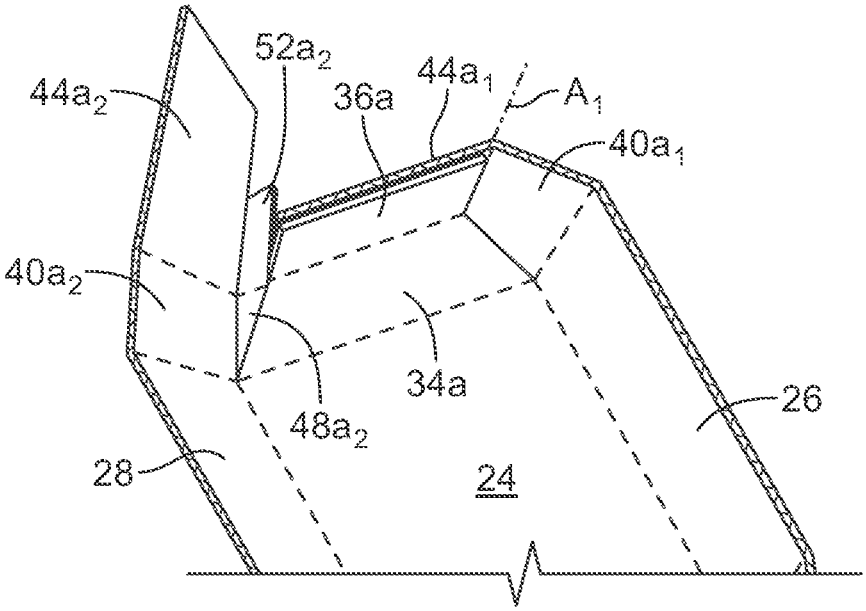
FIG. 5 is a perspective view illustrating overlapping and joining an upper end panel with the first outer end panel.

The second side panel 28, second intermediate panel $\mathbf{40}a_2$, second outer end panel $\mathbf{44}a_2$, second gusset panel $\mathbf{48}a_2$, and second gusset trough panel $\mathbf{52}a_2$ can be folded following similar steps to those described for the first side panel 26 and associated first end structure to position the second gusset panel $\mathbf{48}a_2$ against the second intermediate panel $\mathbf{40}a_2$ and to position the second gusset trough panel $\mathbf{52}a_2$ against the second outer end panel $\mathbf{44}a_2$, see FIG. 5. The second outer end panel $\mathbf{44}a_2$ and the second gusset trough panel $\mathbf{52}a_2$ are folded relative to the second intermediate panel $\mathbf{40}a_2$ about a generally vertical fold axis $A_2$, generally collinear with the score line $\mathbf{46}a_2$, to position the second outer end panel $\mathbf{44}a_2$ and the overlapping second gusset trough panel $\mathbf{52}a_2$ perpendicular to the second side panel 28, see FIG. 6. The second outer end panel $\mathbf{44}a_2$ can be located in overlapping relationship with the first outer end panel $\mathbf{44}a_1$ and can be adhesively attached to the first outer end panel $\mathbf{44}a_1$.

Although the first and second outer end panels $\mathbf{44}a_1$, $\mathbf{44}a_2$ are described as overlapping, it should be understood that in an alternative construction of the tray end wall 56*a*, one or both of the first and second outer end panels $\mathbf{44}a_1$, $\mathbf{44}a_2$ may be shortened such that the first and second outer end panels $\mathbf{44}a_1$, $\mathbf{44}a_2$ do not overlap when positioned adjacent to the upper end panel 36*a*.

The combined structure of the first outer end panel $\mathbf{44}a_1$, the second outer end panel $\mathbf{44}a_2$, and the upper end panel 36*a* form a first vertical tray end wall 56*a*. In the completed tray structure, the lower end wall 34*a* extends upward and outward from the bottom panel 24 to the tray end wall 56*a*, wherein the angled edges of the lower end panel 34*a*, i.e., at the score lines $\mathbf{50}a_{1'}$, $\mathbf{50}a_{2'}$, extend along the respective intermediate panels $\mathbf{40}a_1$, $\mathbf{40}a_2$. The upwardly angled lower end panel 34*a* and vertical upper end panel 36*a* of the inner end panel structure 32*a* define an inner surface of the tray at the first vertical tray end wall 56*a*. It may be noted that the upwardly angled lower end panel 34*a* provides a lower support structure in the tray that avoids a sharp lower corner adjacent to the bottom panel 24 that can facilitate release of a product, such as a protein product contained in a bag, during removal of the bagged product from the tray.

It should be understood that the particular order of attachment of the panels forming the tray end wall 56*a* may vary from the order described herein without departing from the present invention. Further, it should be understood that the steps for folding the panels forming the second end portion 30*b* of the blank 10, such as to form a second tray end wall 56*b*, can be performed in a manner similar to that described for folding the first end portion 30*a* and is therefore not described in detail herein.

Figure 6:
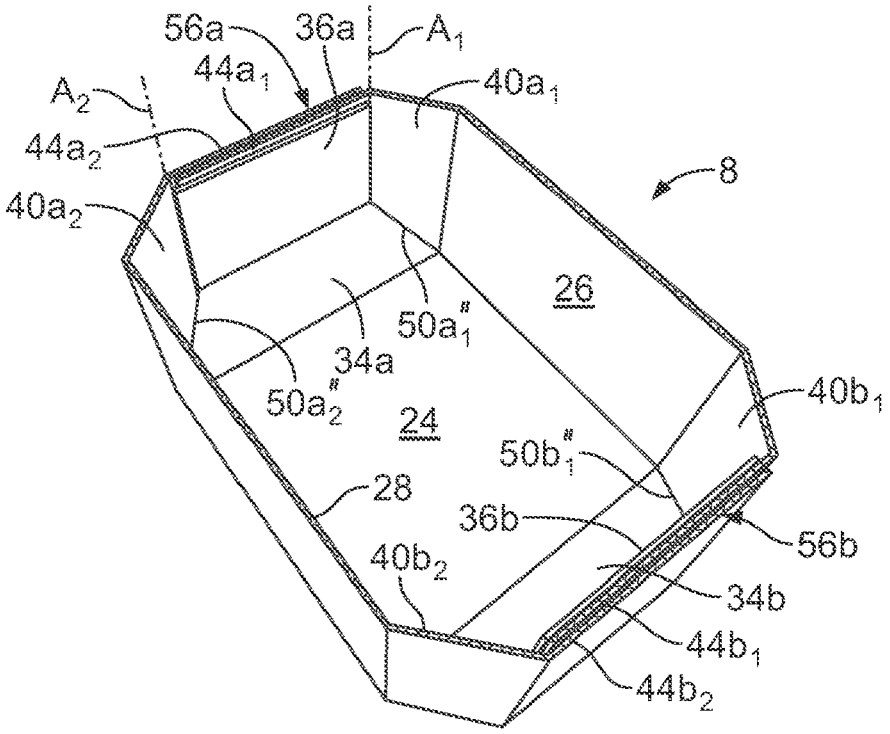
FIG. 6 is a top perspective view of the erected leak resistant tray.
Figure 7:
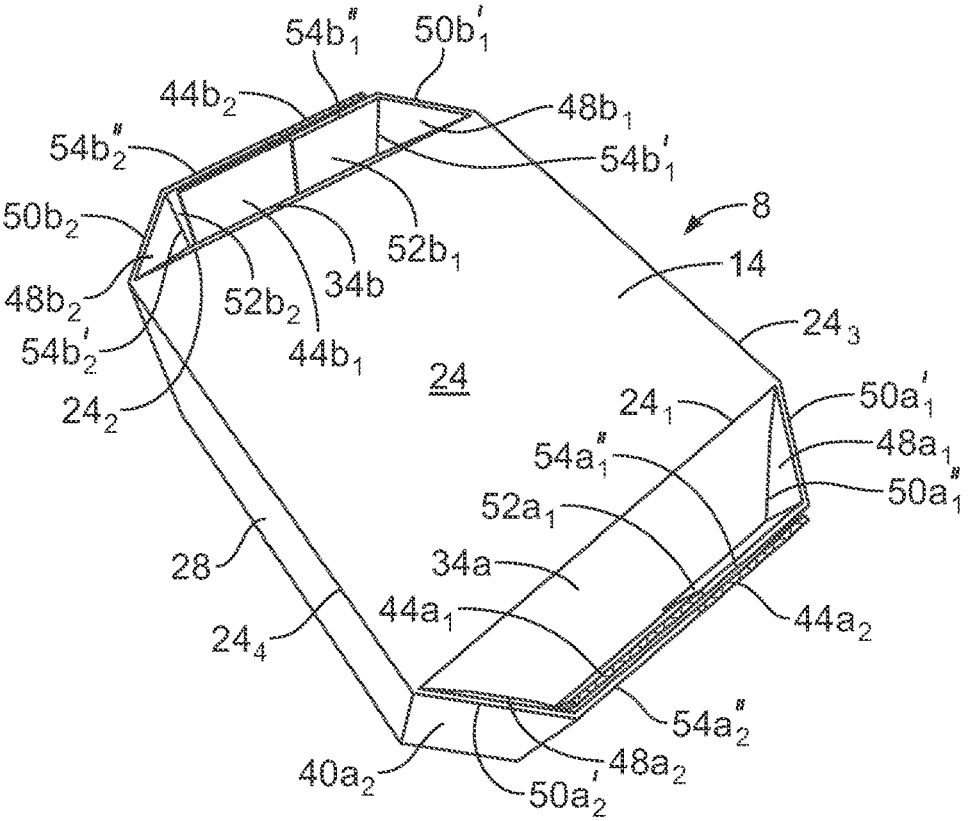
FIG. 7 is a bottom perspective view of the erected leak resistant tray.

Referring to FIG. 6, it can be seen that the erected tray 8 comprises an octagonal wall structure formed by opposing generally vertical side walls defined by the side wall panels 26, 28, opposing end walls 56*a*, 56*b*, and generally vertical intermediate walls defined by the intermediate panels $\mathbf{40}a_1$, $\mathbf{40}a_2$, $\mathbf{40}b_1$, $\mathbf{40}b_2$. The octagon wall structure can provide an increased vertical wall strength, i.e., for stacking, as compared to other container configurations such as, for example, four sided trays. Referring further to FIG. 7, it can be seen that first lower edges of the tray 8 are defined at the peripheral edges $\mathbf{24}_1$, $\mathbf{24}_2$, $\mathbf{24}_3$, $\mathbf{24}_4$ of the bottom panel 24. Second lower edges of the tray 8 are defined at the lower edges of the outer end panels $\mathbf{44}a_1$, $\mathbf{44}a_2$, $\mathbf{44}b_1$, $\mathbf{44}b_2$, and at the lower edges of the intermediate panels $\mathbf{40}a_1$, $\mathbf{40}a_2$, $\mathbf{40}b_1$, $\mathbf{40}b_2$.

It should be noted that although the side walls defined by the side wall panels 26, 28 are illustrated as generally vertical, an alternative configuration of the tray may include side walls that are oriented upward at an angle extending outward or inward from the bottom panel 24.

As may be understood from the above description, the gusset panels $\mathbf{48}a_1$, $\mathbf{48}a_2$, $\mathbf{48}b_1$, $\mathbf{48}b_2$ and respective gusset trough panels $\mathbf{52}a_1$, $\mathbf{52}a_2$, $\mathbf{52}b_1$, $\mathbf{52}b_2$ form continuous gusset structures that extend from each corner of the bottom panel 24, along the lower edges of the intermediate panels $\mathbf{40}a_1$, $\mathbf{40}a_2$, $\mathbf{40}b_1$, $\mathbf{40}b_2$, and along approximately half the width of the respective outer end panels $\mathbf{44}a_1$, $\mathbf{44}a_2$, $\mathbf{44}b_1$, $\mathbf{44}b_2$. In addition to the gusset panels $\mathbf{48}a_1$, $\mathbf{48}a_2$, $\mathbf{48}b_1$, $\mathbf{48}b_2$ forming a continuous surface that prevents or resists exit of fluid at the corners of the bottom panel 24, a pinch point is formed at the connection between the gusset panels $\mathbf{48}a_1$, $\mathbf{48}a_2$, $\mathbf{48}b_1$, $\mathbf{48}b_2$ and the gusset trough panels $\mathbf{52}a_1$, $\mathbf{52}a_2$, $\mathbf{52}b_1$, $\mathbf{52}b_2$, e.g., as depicted at the generally vertical fold axes $A_1$ and $A_2$, to prevent or resist any fluid collected along the connection between the gusset panels $\mathbf{48}a_1$, $\mathbf{48}a_2$, $\mathbf{48}b_1$, $\mathbf{48}b_2$ and the intermediate panels $\mathbf{40}a_1$, $\mathbf{40}a_2$, $\mathbf{40}b_1$, $\mathbf{40}b_2$ from traveling into the trough-like structures defined between gusset trough panels $\mathbf{52}a_1$, $\mathbf{52}a_2$, $\mathbf{52}b_1$, $\mathbf{52}b_2$ and the outer end panels $\mathbf{44}a_1$, $\mathbf{44}a_2$, $\mathbf{44}b_1$, $\mathbf{44}b_2$, which trough-like structures form an additional barrier to passage of fluid. For example, the tray 8 may be used to contain protein of poultry, which may result in fluid being present in the bottom of the tray 8, and the continuous gusset structures can operate to retain the fluid from exiting the lower edges of the tray 8.

The above described configuration for the trough 8 further provides a structure having an improved strength in the vertical direction to facilitate stacking of the tray 8 with other trays. As noted above, the corrugated cardboard material forming the blank 10 has an internal configuration of flutes F (see FIG. 1), and the elongated dimension of the flutes F extends in the lateral direction $L_2$, generally parallel the longitudinal peripheral edges $\mathbf{24}_1$, $\mathbf{24}_2$. It should be understood that the greatest strength of the corrugated cardboard panels, such as to resist bending or buckling of the panel, is provided in a direction parallel to the direction of the flutes. Hence, in order to provide strength to the tray 8 for resisting distortion or collapse of the tray 8 from vertical (stacking) forces, each of the walls forming the tray 8 has flutes F oriented in the vertical direction. Specifically, the described folding operation positions the side panels 26, 28, the intermediate panels 40$a_1$, 40$a_2$, 40$b_1$, 40$b_2$, and the outer end panels 44$a_1$, 44$a_2$, 44$b_1$, 44$b_2$ such that the flutes of the these panels are oriented parallel to the vertical direction. Further, it may be noted that the outer end panels 44$a_1$, 44$a_2$, 44$b_1$, 44$b_2$ can each generally extend the full width of the tray end walls 56*a*, 56*b*, as well as extend the full vertical height of the tray 8 to form reinforcing structures outside of the inner end panel structures 32*a*, 32*b* which, with the other vertical walls of the tray 8 form a continuous wall structure of vertical flutes F around the circumference of the tray 8 for increased stacking strength.

It should be understood that the tray 8 described herein is not intended to be limited by the particular illustrated embodiment or by the terminology applied in the description. For example, while the gusset structures are described as being associated with the end walls illustrated as having a shorter dimension than the side walls, it may be understood that the gusset structures may be associated with the longer walls of the tray, i.e., the side walls, without departing from the invention described herein.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blank for making a leak resistant tray comprising:

a bottom panel having a plurality of peripheral edges;

first and second side panels connected to the bottom panel at opposing lateral peripheral edges and defining lower edges of the tray;

first and second end portions located at opposing longitudinal ends of the blank, each end portion including:

inner end panel structure connected to a longitudinal peripheral edge of the bottom panel, the inner end panel structure including a lower end panel and an upper end panel;

first and second intermediate panels, each intermediate panel connected to a respective one of the first and second side panels and having an edge defining a lower edge of the tray;

first and second outer end panels, each outer end panel connected to a respective one of the first and second intermediate panels and having an edge defining a lower edge of the tray, wherein an edge of each intermediate panel and an edge of a respective adjacent outer end panel is collinear with a lateral peripheral edge of the bottom panel;

first and second triangular gusset panels, each gusset panel connected between one of the intermediate panels and the lower end panel; and first and second gusset trough panels, each gusset trough panel connected to one of the gusset panels and to the lower edge of one of the outer end panels.

2. The blank as set forth in claim 1, wherein the lower end panel is a trapezoidal shape.

3. The blank as set forth in claim 1, wherein a longitudinal dimension of the lower end panel, extending in a direction from the bottom panel to the upper end panel, is generally equal to a longitudinal dimension of the intermediate panels.

4. The blank as set forth in claim 1, wherein the first and second gusset trough panels each include an edge adjacent to a lateral edge the upper end panel and separated from the lateral edge of the upper end panel by a slit.

5. The blank as set forth in claim 4, wherein the slit extends from a connection between the lower end panel and the upper end panel.

6. The blank as set forth in claim 1, wherein the blank is formed of a corrugated cardboard material including an interior defined by elongated flutes, and a direction of elongation of the flutes extends in a lateral direction parallel to the longitudinal peripheral edges of the bottom panel.

7. The blank as set forth in claim 1, wherein the lower end panel connects to a longitudinal peripheral edge of the bottom panel at a location defining a lower edge of the tray.

8. A tray formed from a blank including a bottom panel having a plurality of peripheral edges, first and second side panels connected to the bottom panel at opposing lateral peripheral edges and folded upward relative to the bottom panel, first and second end portions located at opposing longitudinal ends of the blank, each end portion including:

inner end panel structure connected to a longitudinal peripheral edge of the bottom panel, the inner end panel structure including a lower end panel;

first and second intermediate panels, each intermediate panel connected to a respective one of the first and second side panels and extending upward from the bottom panel;

first and second outer end panels, each outer end panel connected to a respective one of the first and second intermediate panels and extending generally perpendicular to the side panels;

first and second triangular gusset panels, each gusset panel connected between one of the intermediate panels and the lower end panel and extending downward from the lower end panel; and first and second gusset trough panels, each gusset trough panel connected to one of the gusset panels and to the lower edge of one of the outer end panels and folded upward to overlapping relationship with a respective outer end panel.

9. The tray as set forth in claim 8, wherein the gusset panels are each located in overlapping relationship with a respective intermediate panel.

10. The tray as set forth in claim 9, wherein an edge of the first and second outer end panels connected to respective ones of the gusset trough panels defines a lower edge of the tray.

11. The tray as set forth in claim 10, wherein an edge of the intermediate panels connected to the gusset panels defines a lower edge of the tray.

12. The tray as set forth in claim 8, wherein the first outer end panel is located in overlapping relationship with the second outer end panel.

13. The tray as set forth in claim 12, wherein the inner end panel structure further includes an upper end panel connected to the lower end panel, and the first and second outer end panels are located in overlapping relationship with the upper end panel to define a tray end wall generally perpendicular to the bottom panel.

14. The tray as set forth in claim 13, wherein the lower end panel extends upward and outward from the bottom panel to the tray end wall.

15. The tray as set forth in claim 12, wherein the side panels, intermediate panels and tray end walls define an octagonal wall structure for the tray.

16. The tray as set forth in claim 8, wherein the blank is formed of a corrugated cardboard material including an interior defined by elongated flutes, and a direction of elongation of the flutes in the side panels, the intermediate panels and the outer end panels extends in a vertical direction generally perpendicular to the bottom panel.

* * * * *